US007014513B2

(12) United States Patent
Tomasino

(10) Patent No.: US 7,014,513 B2
(45) Date of Patent: Mar. 21, 2006

(54) WEATHERTIGHT ELECTRICAL CONNECTOR

(75) Inventor: Guy Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 10/792,920

(22) Filed: Mar. 5, 2004

(65) Prior Publication Data

US 2004/0192121 A1 Sep. 30, 2004

Related U.S. Application Data

(63) Continuation-in-part of application No. 10/266,947, filed on Oct. 9, 2002, now Pat. No. 6,830,491.

(51) Int. Cl.
*H01R 11/09* (2006.01)

(52) U.S. Cl. ..... 439/784; 439/322; 439/274

(58) Field of Classification Search ..... 439/349, 439/805, 412, 411, 322, 784, 274
See application file for complete search history.

(56) References Cited

U.S. PATENT DOCUMENTS

| | | | | | |
|---|---|---|---|---|---|
| 939,501 | A | * | 11/1909 | Hinds | 403/308 |
| 1,646,660 | A | * | 10/1927 | Prince | 439/805 |
| 1,710,416 | A | * | 4/1929 | Goeller | 439/431 |
| 5,228,875 | A | | 7/1993 | Swenson, Sr. | 439/784 |
| 5,695,369 | A | | 12/1997 | Swenson, Sr. | 439/784 |
| 5,868,589 | A | | 2/1999 | Swenson, Sr. | 439/784 |
| 6,321,021 | B1 | * | 11/2001 | Cairns et al. | 385/138 |

* cited by examiner

*Primary Examiner*—Hae Moon Hyeon
(74) *Attorney, Agent, or Firm*—Jim Zegeer

(57) ABSTRACT

A weathertight connector for electrical connectors having multiple connection chambers. Compression seals are used for each connection chamber.

6 Claims, 6 Drawing Sheets

WEATHERTIGHT ELECTRICAL CONNECTOR

REFERENCE TO RELATED APPLICATION

The present application is a continuation-in-part application of Ser. No. 10/266,947, filed Oct. 9, 2002, now U.S. Pat. No. 6,830,491 and entitled WEATHERTIGHT ELECTRICAL CONNECTOR.

BACKGROUND AND BRIEF DESCRIPTION OF THE INVENTION

The present invention is directed to a weathertight electrical connector using the positive wire-locking features of U.S. Pat. Nos. 5,228,875, 5,695,369 and 5,868,589 which features are adapted in a unique manner to achieve a weathertight connector. It is an improvement in the connector shown in U.S. Ser. No. 10/266,947.

The electrical connecting of two discrete wires using the positive wire locking features of the above-referenced U.S. patents has been highly successful commercially and sold under the trademark POSI-LOCK by the assignee hereof. In the electrical connectors of the type disclosed in the above-identified patents as well as others, a connection chamber is formed in an non-conductive body and a conductive metal insert is provided which extends between the two connection chambers. The ends of the conductive element in the connection chambers is shaped as a splaying member for splaying a wire on its surface. The interior surface of the connection chamber is threaded for receiving a threaded male member which has a throughbore, and a portion of the throughbore is shaped to form a complementary surface to the bullet-shaped splaying surface. When a wire is passed through the throughbore and engages the splaying surface, it is splayed along the splaying surface and then a male member having a threaded exterior engaged with threaded connection chamber walls to clamp the wire between the shaped splaying surface and the complementary clamping surface formed on the throughbore male member. It is desirable in a number of situations to provide a weathertight seal for the connection chambers.

The object of the present invention is to provide improved techniques and structures for forming a weathertight connector in which the connection chambers are sealed from the ingress of moisture and the like.

In a preferred embodiment of the invention, a movable discrete clamp member is provided with a throughbore having a complementary surface on it for clamping the wire to the surface of the conductive insert. For each connection chamber, there is a clamp member, and each clamp member has a throughbore, one end of which has the aforesaid clamping surface, the opposite end of which has a recess for receiving a seal in the form of a compression sleeve. The compression sleeve is carried in the end of the non-conductive clamp member, which is adapted to be retained inside a force member. The compression sleeve has an internal wire passage size designed to freely pass the insulation of a wire inserted therein. In a preferred embodiment, the external surface of the connection chamber is threaded, and the force member which, in the preferred embodiment, is threadably engaged with the external threads on the body member engages and advances the compression sleeve and clamping member to force the complementary end of the clamping member against the wire splayed on the splaying member to thereby clamp the wire between the splaying surface and the complementary surface in the throughbore. At the same time, the compression sleeve is being compressed in an axial direction thereby constricting the wire passage in the compression sleeve radially inwardly and thereby seal against the insulation along the length of the internal wire passage. At the same time, the end of the compression sleeve seals the outer end thereof against the inside of the force member. A second seal-ring in the form of a flanged annular sleeve is adapted to be seated in an annular groove and abut an annular shoulder abutting a seal shoulder approximate the mid-point between the two connection chambers. Thus, when the two force members are threadably engaged with the external threads on the body member and caused to move inwardly to clamp the wire between the two clamping surfaces on the conductive member, the ends of the force members engage their respective seal-rings to thereby provide weathertight seals for the connection chambers from external ambient environment.

Thus, the invention features a weathertight connector comprising a non-conductive body member having one or more connection chambers formed therein and a conductive element having a pair of ends, each end being positioned coaxially in one of the connection chambers, respectively, and being shaped to form a crimp-free wire connection, the outer surfaces of the non-conductive body member is threaded at each end. A non-conductive clamp member is adapted to be fitted inside the connection chambers, there being one non-conductive clamp member for each chamber. Each non-conductive clamp member has an internal surface adapted to coact with the operative member for clamping the wire to the shaped end of the conductive element in the connection chamber. Compression seals are adapted to be seated in each clamping member, respectively, and have an internal wire passage sized to pass on the insulation of a wire inserted therethrough. A pair of sealing ring members are seated against an annular flange formed in the external surface of the body member and proximate mid-way between the connection chambers. Force members are threadably engaged with the external threads on the body member and engage the compression sleeve/clamp member to force the clamping member against the wires and thereby clamp the wire to the conductive element end therein. At the same time, the compression sleeve is axially compressed constricting the wire passage to sealingly grip the wire insulator axially along the length thereof. It will be appreciated that the external threads on the body member may be internal and the internal threads on the force members may be external and the seal rings carried on the respective force member.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
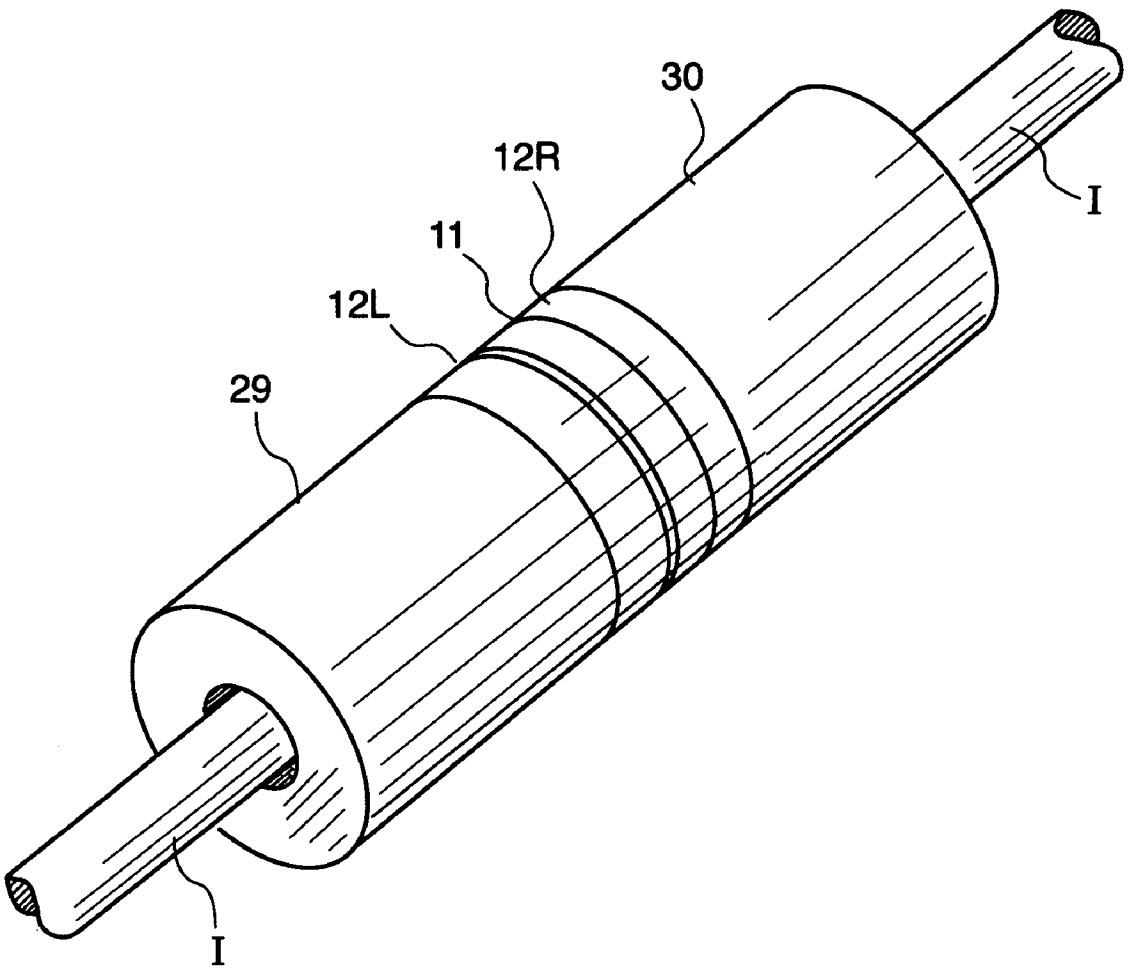
FIG. 1 is an isometric perspective view of a weathertight connector incorporating the invention.

The invention features a non-conductive body member 10 having a central annular rib 11 against which are seated compressive annular seal-ring members 12R and 12L, respectively. The external ends 13 and 14 of body member 10 are threaded and have connection chambers 15 and 16 formed therein. Conductive element CE, which may be brass, copper, or other conductive material, is centrally located in a bulkhead BH which is integrally formed with the body member 10. The conductive element CE has a pair of wire-splaying ends 15SE and 16SE in connection chambers 15 and 16, respectively as disclosed in the manner set forth in the above-identified patents.

Clamp members 17 and 18 have throughbores 19 and 20, said throughbores being shaped at one end to have a complementary internal surface S adapted to coact with the splaying member of a conductive element CE (see FIG. 3) having splaying ends 15SE, 16SE. The opposite ends 23, 24 of the clamp members are cupped to carry compression seal members 25, 26 which are adapted to be seated in the clamping member cup ends 23, 24 and have an internal wire passage sized to allow the free passage of insulation I of the wire inserted therein. Force members 29 and 30 have an internally threaded portion 31, 32 which are adapted to engage the threads of the external ends 13 and 14, respectively, of the non-conductive body member 10. As noted earlier, the threading may be reversed. Compression seal members 12L and 12R and compression seal members 25 and 26 may be made from softer plastic such as thermoplastic polyurethane (TPU).

Force members 29 and 30 have an internal space 41, 42 adapted to sealingly engage annular seals 12L and 12R and an end 43, 44 which engages annular portions 12LV, 12RV of annular seal ring members 12L and 12R. The surface 42 engages the horizontal (in FIG. 2) surfaces 12LH and 12RH.

Figure 3:
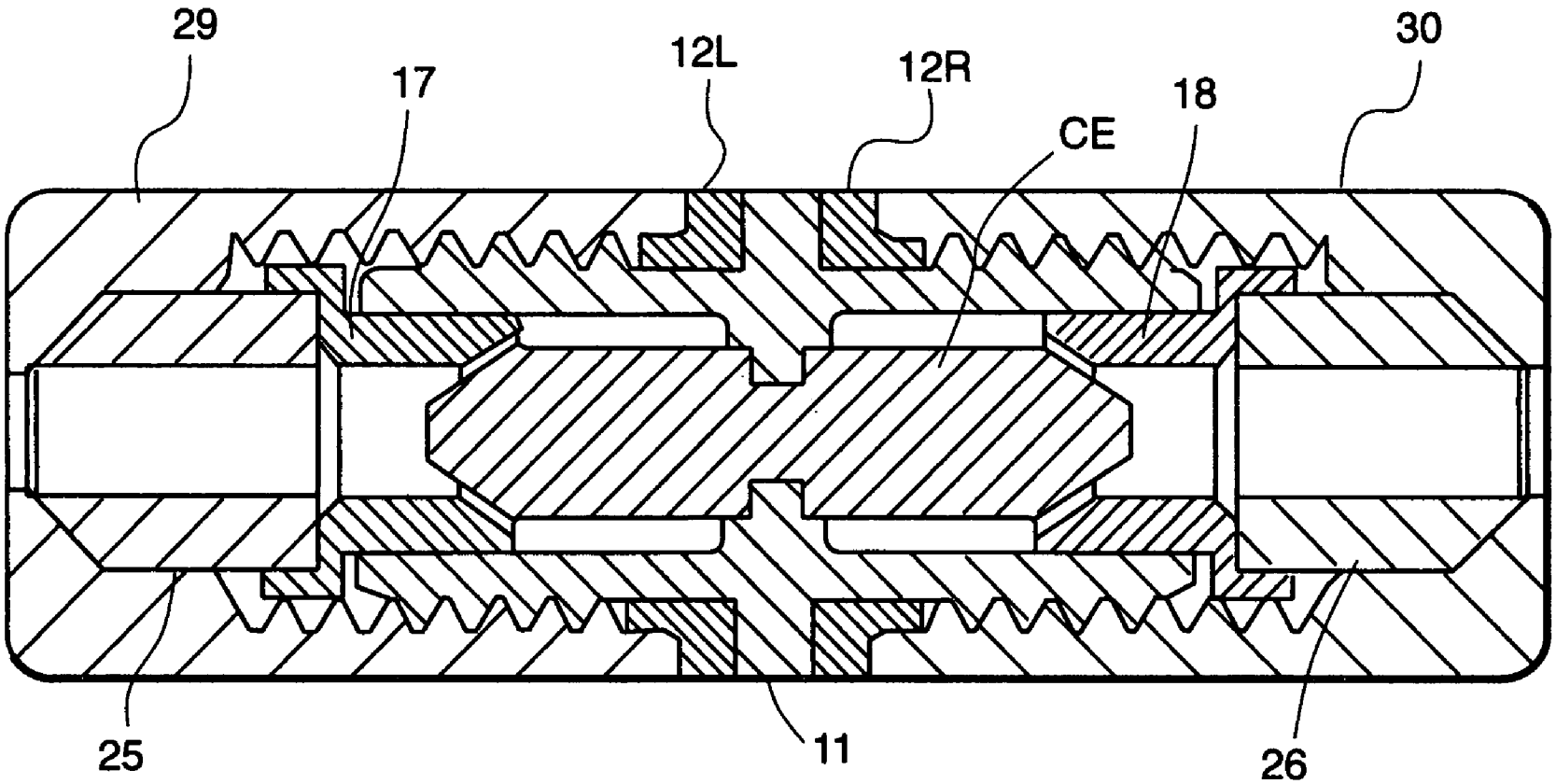
FIG. 3 is a cross-sectional view thereof.

Force members 29 and 30 also are provided with seal recesses 45 and 46 which are adapted to be engaged by the ends 47, 48 of compression seal members 25 and 26 as shown FIG. 3.

When the force members 29 and 30 are turned (they have knurled or grooved surfaces for good gripping) to tighten them on the non-conductive body member 10, clamp members 17 and 18 are urged by the respective force members 29 and 30, and the clamping member is forced against the wire splayed on the splaying member to thereby clamp the wire between the splaying surfaces 15SE, 16SE and the complementary internal surface S on the force member. At the same time, the ends 41, 42 of the force members engage the annular seal-ring members 12L, 12R thereby forming a weathertight arrangement for each of the connection chambers.

As shown in FIG. 3, the force members 29 and 30 are threadably engaged with the threads 13 and 14 of the external ends of the body member 10. At the same time, the force member is bearing down on the seal-ring in the ends of clamp members 17 and 18 which causes the compression seal members 25, 26 to close in or constrict and grip the wire. Thus, two forces are acting on the insulated wire, (1) the conductive wire strands are gripped tightly between the clamping surface of the splaying ends of the conductive elements and (2) the compression seal is gripping the external surfaces of the wire insulation.

Figure 4A:
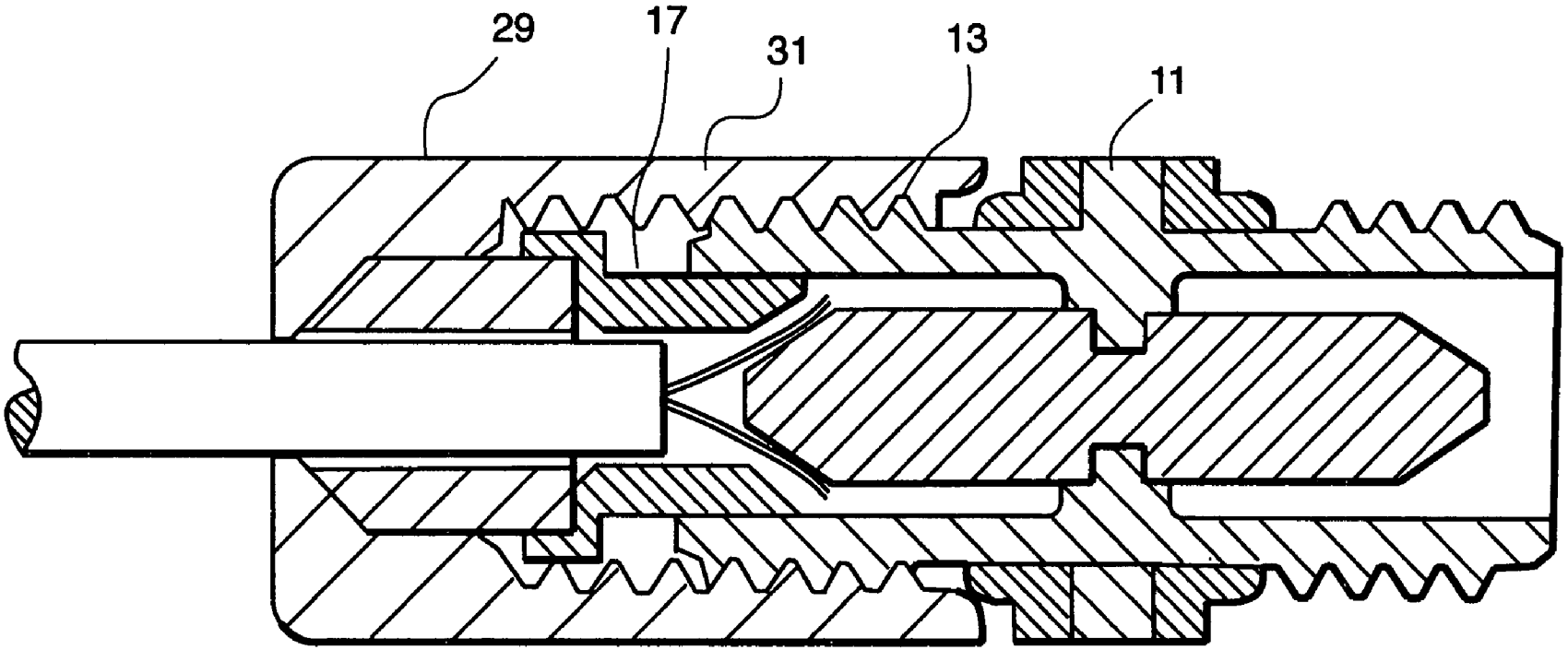
FIGS. 4A and 4B are explanatory sectional views.
Figure 4B:
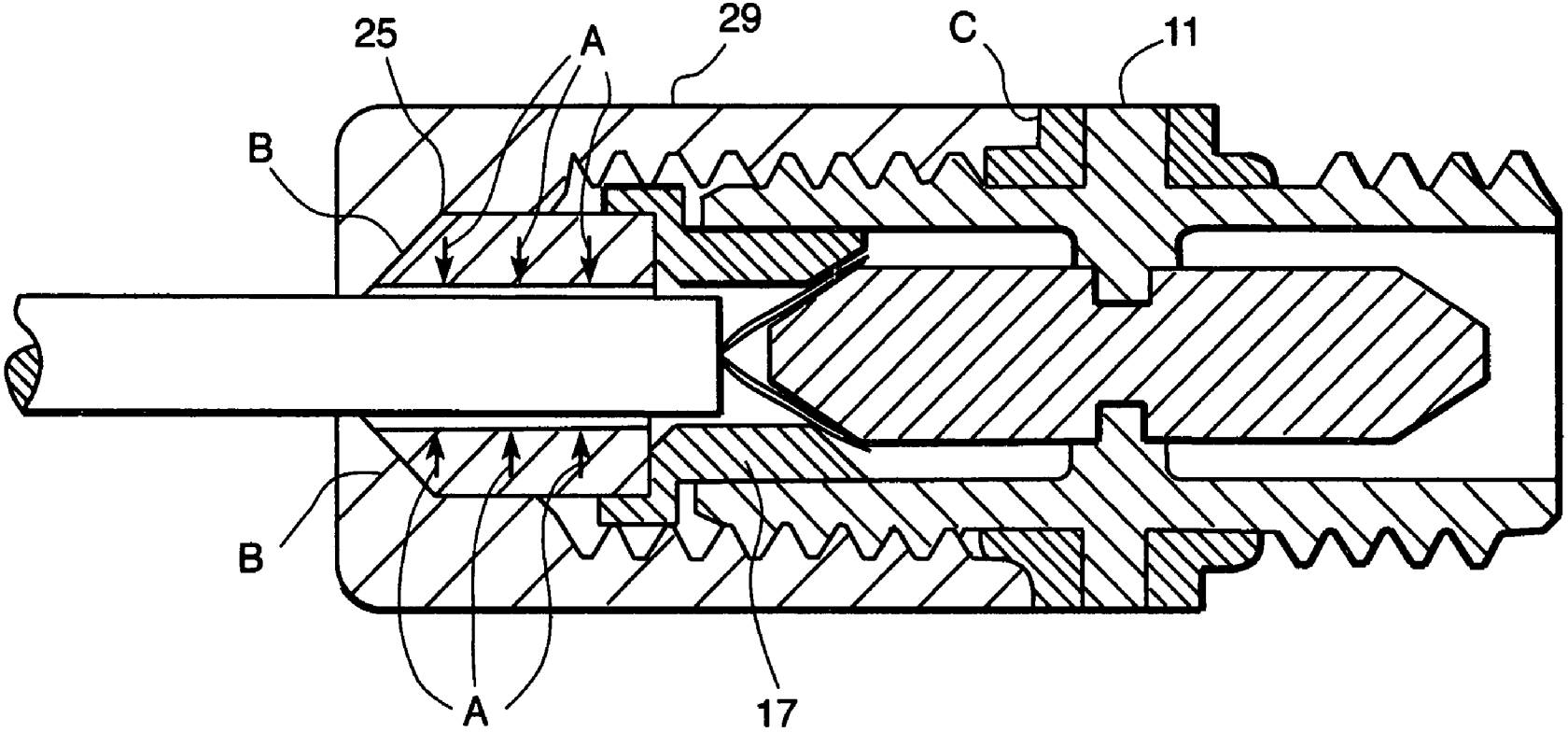

Referring to FIG. 4A, force member 29 is shown as having its thread 31 threadably engaged with thread 13, and by virtue of the threads serves as a multiplier of the twisting force applied thereto. As the force member is rotated, it is advanced on the threads and thereby the advancing the clamp member 17 until the clamp member engages the splayed wires, FIG. 4B, and clamps the splayed wires to the end 15SE on conductive element CE. As the force member 29 is rotated further, the right ends of the clamp member is essentially stationary, and the end 45 of force member 29 is in effect moved closer to the end of the clamping member cup end 23. Further rotation of the force member causes the compression of the compression seal member 25 which, due to the fact that it is constrained, expands radially inward (see arrows A) and outward such that the wire passage is constricted or reduced in diameter to grip the outer insulation and form a weathertight seal. At the same time, the back end of the force member at the area labeled B is sealed tightly at this point. Therefore, it is clear that the gripping of the wire by the constriction of the compression seal 24 forms a seal in the area A and area B. At the same time, the ringseal 12L at the ends of the annular rib 11 are pressed by the end 43 of the force member 29 to compress compression seal at area C so that it may bulge outwardly. Thus, the seals are made at areas A, B and C. It is interesting to note that at the same time that the compression seal member 24 is gripping the wire insulation, and the force member 20 is moving to the right, it forms two additional functions: (1) It grips the wire, thereby further enhancing the strength of the connection and (2) at the same time is urging the wire to better contact the conductive member 21.

Figure 2:
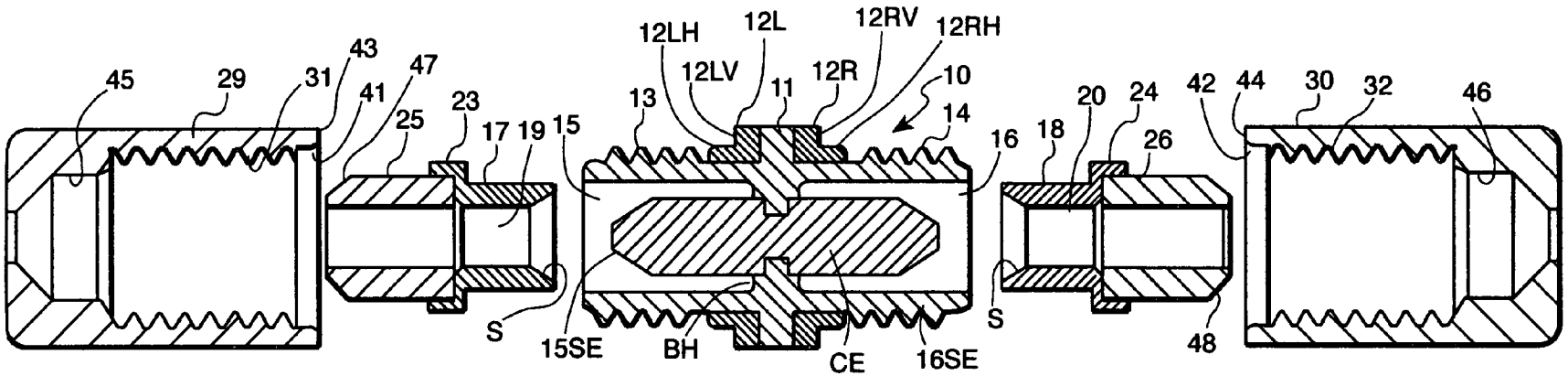
FIG. 2 is an exploded sectional view thereof.
Figure 5:
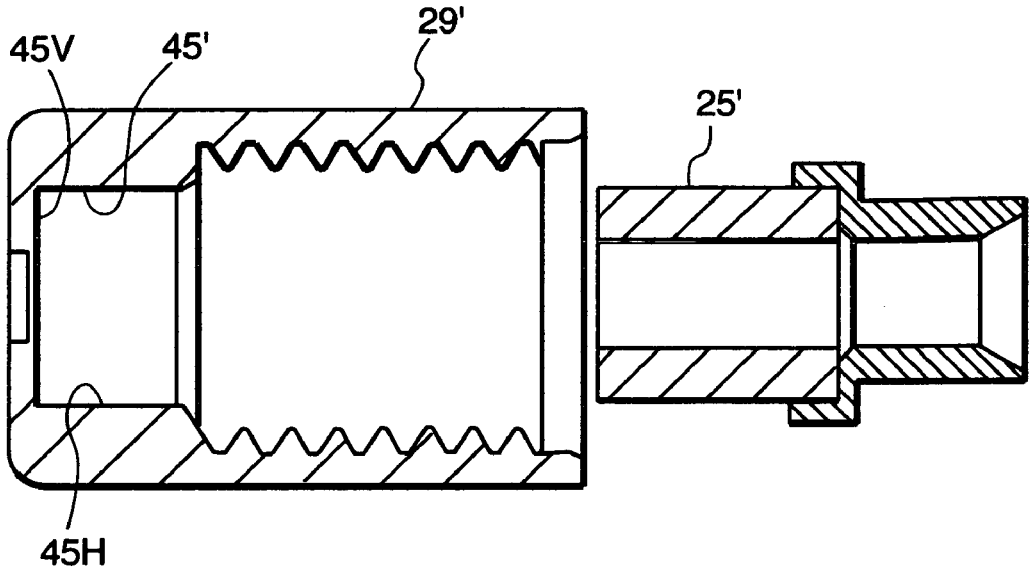
FIGS. 5 and 6 illustrate further embodiments.
Figure 6:
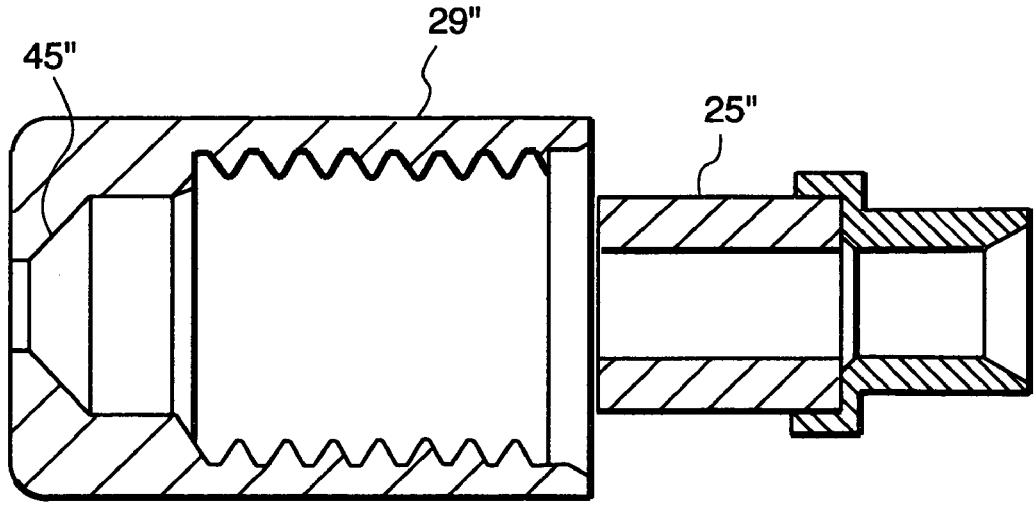

In the embodiment shown in FIG. 5, the end of the compression seal sleeve 25 is square or not chamfered or beveled, as in FIG. 2. At the same time, the internal sealed engaging recess 45 is shaped to conform to the shape of the compression seal member 25'. In this case, the seal is formed against the surface 45V and 45H so that as the compression seal is closed inwardly and expands radially, and seal expansion takes place against the wire insulation. In the embodiment shown in FIG. 6, the end of the compression seal member 25" is squared off, whereas the coacting surface in the force member is chamfered or beveled as at 45".

Instead of a splaying member, the ends of the conductive element in the connection chambers can be shaped to have a wire bore for receiving a wire and a transversely moved ball clamp element seated in a transverse aperture can be forced by the respective clamp members into clamping engagement with the wire in the wire bore by the non-conductive clamp member.

While preferred embodiments of the invention have been shown and described, it will be appreciated that many other embodiments, adaptations, changes and modifications to the invention can be done by those skilled in the art.

What is claimed is:

1. A weathertight electrical connector comprising a non-conductive body member having two or more connection chambers formed therein and a conductive element having a pair of ends, each end being positioned coaxially in one of said connection chambers, respectively, and being shaped in a form of a crimp-free wire connection member, said non-conductive body member having a pair of threaded ends and a central annular rib, at least a pair of clamp members, one in each connection chamber, first compression seal members adapted to be seated in said clamp member, respectively, and having an internal wire passage sized to pass on the insulation of a wire inserted therein, and a force member adapted to threadably engage with said threads on said body member and engage and urge said clamp member to clamp the wire on said conductive member to thereby clamp said wire to said conductive element, and second compression seal members seated against said central annular rib on the exterior of the body member mid-way between the connection chambers and engageable by an end of said force member.

2. A weathertight electrical connector comprising a non-conductive body member having a pair of connection chambers formed therein and a conductive element having a pair of ends, each end being positioned coaxially in one of said connection chambers, respectively, and being shaped in the form of a wire-splaying member, the outer surfaces of said non-conductive body member being threaded at each end thereof and having an annular rib, a non-conductive clamp member adapted to be fitted inside said connection chamber and having an internal complementary surface adapted to coact with said wire splaying member to clamp the wire therebetween, compression seal members adapted to be seated in each said clamp member, respectively, and having an internal wire passage sized to closely fit on the insulation of a wire inserted therein, and a force member adapted to threadably engage with said external threads on said body member and compression seal member and force said clamping member against the wire splayed on said splaying member to thereby clamp said wire between said splaying surface and said internal complementary surface and axially compress said compression seal, thereby reducing the diameter of said wire passage to grip and seal along the length of said wire insulation, second compression seal members seated against said annular rib on the exterior of the body member mid-way between the connection chambers and engageable by ends of said force member, respectively.

3. In an electrical connector having an insulated body member, at least one connection chamber having an external threaded wall and a conductive wire splaying member coaxially mounted in said connection chamber, a force member having an internally threaded wall for threaded engagement with said external threaded wall, the improvement comprising: said insulated body member having an external annular rib, a compressible seal ring having an end butted against said rib and sealingly engageable by said force member when it is threadably engaged with said external threaded wall, a clamp member having a cup in the end thereof, said clamp member having a throughbore, a compression seal member mounted in said cup, said compression seal member having an axial, insulated wire passage coaxial with said throughbore, said clamp member having an end facing said wire splaying member and adapted to clamp a bare wire end to said splaying member, whereby advancement of said force member axially compresses said seal ring and said seal member constricting said wire passage to seal along a length of said wire and said connection chamber is made weathertight.

4. An electrical connector comprising a non-conductive body member having a connection chamber formed therein, a conductive element fixedly mounted in said connection chamber and having an end shaped in the form of a wire splaying member, said conductive element being coaxially mounted in said connection chamber, said connection chamber having a threaded external wall, a non-conductive clamp member adapted to be fitted inside said connection chamber and a force member having a threaded internal wall surface adapted to be threadably engaged with said threaded external wall of said connection chamber and having an internal complementary surface adapted to coact with said splaying member to clamp a wire therebetween, the improvement for rendering said connection chamber weathertight comprising:

a first compression seal member coaxially seated in said clamp member and having an internal aperture size to sealingly grip on the insulation of a wire inserted therein, and a second compression seal member seated on the exterior of said body member and engageable by the end of said non-conductive clamp member when said force member is rotated to force said clamping member against the wire splayed on said splaying member to thereby clamp said wire between said splaying member and said internal complementary surface in a weathertight chamber.

5. A claim member of a weathertight electrical connector comprising:

a non-conductive clamp member having on one end an internal surface adapted to coact with a conductive element for clamping a wire to the end of the conductive element, said non-conductive clamp member having a cup in another end thereof and a compression seal member adapted to be seated in and carried in said cup and having an internal wire passage sized to pass on the insulation of a wire inserted therethrough, and, upon compression of said compression seal member, constricts said internal wire passage on said insulation.

6. The clamp member defined in claim 5 wherein said internal wire passage has a length such that on compression of said compression seal member said wire is sealingly gripped thereby.

* * * * *

UNITED STATES PATENT AND TRADEMARK OFFICE

CERTIFICATE OF CORRECTION

PATENT NO. : 7,014,513 B2
DATED : March 21, 2006
INVENTOR(S) : Guy Tomasino

It is certified that error appears in the above-identified patent and that said Letters Patent is hereby corrected as shown below:

Column 6,
Line 31, should read as follows:
-- 5. A clamp member of a weathertight electrical connector --.

Signed and Sealed this

Thirteenth Day of June, 2006

JON W. DUDAS
*Director of the United States Patent and Trademark Office*